US006875292B2

(12) United States Patent
Worthing, Jr. et al.

(10) Patent No.: US 6,875,292 B2
(45) Date of Patent: Apr. 5, 2005

(54) PROCESS FOR REJUVENATING A DIFFUSION ALUMINIDE COATING

(75) Inventors: Richard Roy Worthing, Jr., Cincinnati, OH (US); Shannon Lynette Cismoski, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 98 days.

(21) Appl. No.: 10/029,350

(22) Filed: Dec. 20, 2001

(65) Prior Publication Data

US 2003/0116237 A1 Jun. 26, 2003

(51) Int. Cl.[7] ..... B08B 3/08

(52) U.S. Cl. ..... 148/535; 134/3; 134/41; 252/79.2

(58) Field of Search ..... 148/535; 134/3, 134/41; 252/79.2

(56) References Cited

U.S. PATENT DOCUMENTS 3,607,398 A * 9/1971 Lucas ..... 134/3
3,622,391 A 11/1971 Baldi et al. ..... 134/3
3,833,414 A 9/1974 Grisik et al. ..... 216/53
4,339,282 A 7/1982 Lada et al. ..... 134/3
6,174,448 B1 1/2001 Das et al. ..... 216/2

FOREIGN PATENT DOCUMENTS

EP 1136593 9/2001
EP 1162286 12/2001

* cited by examiner

*Primary Examiner*—Roy King
*Assistant Examiner*—Janelle Morillo
(74) *Attorney, Agent, or Firm*—David L. Narciso; Gary M. Hartman; Domenica N. S. Hartman

(57) ABSTRACT

A process of rejuvenating a diffusion aluminide coating on a component. The rejuvenation process involves treating the coating with an aqueous solution of nitric acid and phosphoric acid until at least part of the additive layer of the coating has been removed, but the diffusion zone underlying the additive layer remains. The exposed surface of the component is then re-aluminized to deposit additional aluminum to build up the additive layer to a desired thickness. While potentially useful for a variety of situations, the process is particularly applicable to a diffusion aluminide coating that has been deposited on a component to have an excessively thick additive layer, and prior to the component being returned to service.

16 Claims, 1 Drawing Sheet

PROCESS FOR REJUVENATING A DIFFUSION ALUMINIDE COATING

CROSS REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

This invention relates to diffusion coatings for components exposed to oxidizing and corrosive environments, such as the hostile environment of a gas turbine engine. More particularly, this invention is directed to a process for rejuvenating a diffusion aluminide coating without entirely removing the coating from a substrate.

2. Description of Related Art

Higher operating temperatures for gas turbine engines are continuously sought in order to increase their efficiency. However, as operating temperatures increase, the high temperature durability of the components of the engine must correspondingly increase. Significant advances in high-temperature capabilities have been achieved through the formulation of nickel and cobalt-base superalloys, though without a protective coating components formed from superalloys typically cannot withstand long service exposures if located in certain sections of a gas turbine engine, such as the turbine, combustor and augmentor. One such type of coating is referred to as an environmental coating, i.e., a coating that is resistant to oxidation and hot corrosion. Environmental coatings that have found wide use include diffusion aluminide coatings formed by diffusion processes, such as a pack cementation and vapor phase processes.

Diffusion processes generally entail reacting the surface of a component with an aluminum-containing gas composition to form two distinct zones, the outermost of which is an additive layer containing an environmentally-resistant intermetallic represented by MAI, where M is iron, nickel or cobalt, depending on the substrate material. The MAI intermetallic is the result of deposited aluminum and an outward diffusion of iron, nickel and/or cobalt from the substrate. During high temperature exposure in air, the MAI intermetallic forms a protective aluminum oxide (alumina) scale that inhibits oxidation of the diffusion coating and the underlying substrate. The chemistry of the additive layer can be modified by the presence in the aluminum-containing composition of additional elements, such as platinum, chromium, silicon, rhodium, hafnium, yttrium and zirconium. Diffusion aluminide coatings containing platinum, referred to as platinum aluminide coatings, are particularly widely used on gas turbine engine components. Platinum is typically incorporated into the coating by electroplating a layer of platinum on the substrate prior to aluminizing, yielding an additive layer that includes (Pt)NiAl-type intermetallic phases, usually $PtAl_2$ or platinum in solution.

The second zone of a diffusion aluminide coating is formed in the surface region of the component beneath the additive layer. The diffusion zone contains various intermetallic and metastable phases that form during the coating reaction as a result of diffusional gradients and changes in elemental solubility in the local region of the substrate. The intermetallics within the diffusion zone are the products of all alloying elements of the substrate and diffusion coating.

Though significant advances have been made with environmental coating materials and processes for forming such coatings, there is the inevitable requirement to repair these coatings under certain circumstances. For example, removal may be necessitated by erosion or thermal degradation of the diffusion coating, refurbishment of the component on which the coating is formed, or an in-process repair of the diffusion coating or a thermal barrier coating (if present) adhered to the component by the diffusion coating. The current state-of-the-art repair process is to completely remove a diffusion aluminide coating by treatment with an acidic solution capable of interacting with and removing both the additive and diffusion layers. An example of such a process is disclosed in commonly-assigned U.S. Pat. No. 3,833,414 to Grisik et al. The Grisik process relies on lengthy exposures to an aqueous solution of nitric and phosphoric acids, followed by treatment with an alkaline permanganate solution to completely remove the coating.

Removal of the entire aluminide coating, which includes the diffusion zone, results in the removal of a portion of the substrate surface. For gas turbine engine blade and vane airfoils, removing the diffusion zone can cause alloy depletion of the substrate surface and, for air-cooled components, excessively thinned walls and drastically altered airflow characteristics to the extent that the component must be scrapped. Therefore, rejuvenation processes have been developed for situations in which a diffusion aluminide coating must be refurbished in its entirety, but removal of the coating is not desired or allowed because of the effect on component life. Rejuvenation processes generally entail cleaning the surface of a component, followed by a controlled-activity aluminizing process that deposits additional aluminum on the component.

On occasion, excessive coating is deposited by rejuvenation processes, for example, the additive layer has a thickness in excess of about 100 micrometers. If the component has not been previously refurbished by completely removing its aluminide coating, the entire coating (i.e., additive layer and diffusion zone) can be fully stripped and the component re-aluminized. However, if the component has been previously refurbished by having its aluminide coating completely removed, thereby reducing its wall thickness, it may be necessary to scrap the component.

From the above, it can be appreciated that improved methods for refurbishing a diffusion aluminide coating are desired, particularly for those components that have undergone rejuvenation to have an excessively thick aluminide coating.

BRIEF SUMMARY OF THE INVENTION

The present invention generally provides a process of rejuvenating a diffusion aluminide coating on a component designed for use in a hostile environment, such as superalloy turbine, combustor and augmentor components of a gas turbine engine. The rejuvenation process of this invention involves removing part or all of the additive layer of a diffusion aluminide coating with minimal attack of the underlying diffusion zone, such that alloy depletion and thinning of the underlying substrate does not occur. The component is then re-aluminized to restore the additive layer of the coating. While potentially useful for a variety of situations, the process of this invention is particularly applicable to a diffusion aluminide coating that has been recently deposited on a component before the component has been placed in service, and particularly to a coating that was rejuvenated but the resulting additive layer was deposited to an excessive thickness. In this case, because the coating has not seen service, such as in the elevated temperatures of a gas turbine engine, limited interdiffusion has occurred between the component substrate and the additive layer.

The process of this invention involves treating the diffusion aluminide coating with an aqueous solution consisting essentially of nitric acid and phosphoric acid at a temperature of about 70° C. to about 80° C. until at least part of the additive layer has been removed but the substrate remains unaffected. The exposed treated surface of the component is then aluminized to deposit additional aluminum to build up the additive layer to a desired thickness.

According to the invention, the solution of nitric and phosphoric acids at the temperature used in the treatment step does not completely remove the diffusion aluminum coating, as has been the practice with prior art stripping methods. Instead, limited use of the acid solution is capable of cleanly removing the additive layer of a diffusion aluminide coating without attacking the substrate, such that alloy depletion and wall thinning of the substrate does not occur. As such, the reliability and service life of components refurbished by the process of this invention are significantly improved over that possible with prior art methods. While not wishing to be held to any theory, it is believed that the substrate is not attacked because the acid solution is selective to aluminum at the prescribed temperatures. In addition, if the diffusion aluminide is a platinum aluminide, the platinum content of the coating appears to act as a catalyst for the selective removal of aluminum. The process of this invention is most effective with a diffusion aluminide coating having only limited interdiffusion, such that the additive layer and the diffusion zone are well defined, as is the case when the diffusion aluminide coating on a gas turbine engine has been rejuvenated but before the component has been returned to engine service. As discussed above, a notable example of such a situation is when a coating has been rejuvenated but the resulting additive layer is excessively thick for its intended application.

Other objects and advantages of this invention will be better appreciated from the following detailed description.

DETAILED DESCRIPTION OF THE INVENTION

The present invention is generally applicable to components that are protected from a thermally and chemically hostile environment by a diffusion aluminide coating. Notable examples of such components include the high and low pressure turbine nozzles and blades, shrouds, combustor liners and augmentor hardware of gas turbine engines. While the advantages of this invention are particularly applicable to gas turbine engine components, the teachings of this invention are generally applicable to any component on which a diffusion aluminide coating may be used to protect the component from its environment.

Figure 1:
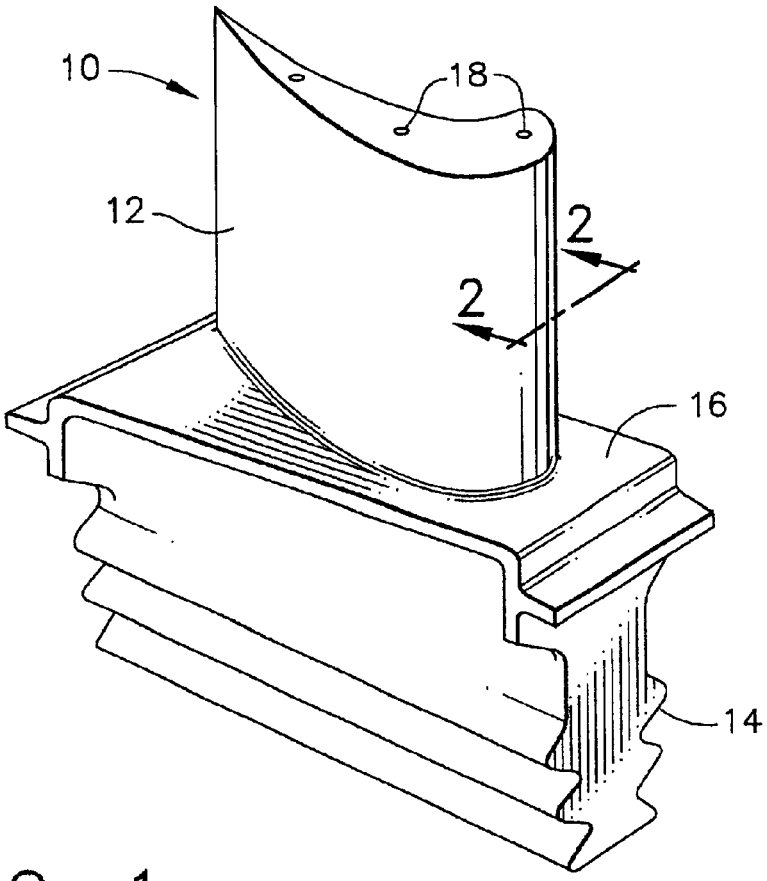
FIG. 1 is a perspective view of a high pressure turbine blade of a gas turbine engine.

An example of a high pressure turbine blade 10 is shown in FIG. 1. The blade 10 generally has an airfoil 12 and platform 16 against which hot combustion gases are directed during operation of the gas turbine engine, and whose surfaces are therefore subjected to severe attack by oxidation, corrosion and erosion. The airfoil 12 is anchored to a turbine disk (not shown) with a dovetail 14 formed on a root section of the blade 10. Cooling holes 18 are present in the airfoil 12 through which bleed air is forced to transfer heat from the blade 10. Particularly suitable materials for the blade 10 include nickel and cobalt-base superalloys, though it is foreseeable that other materials could be used.

Figure 2:
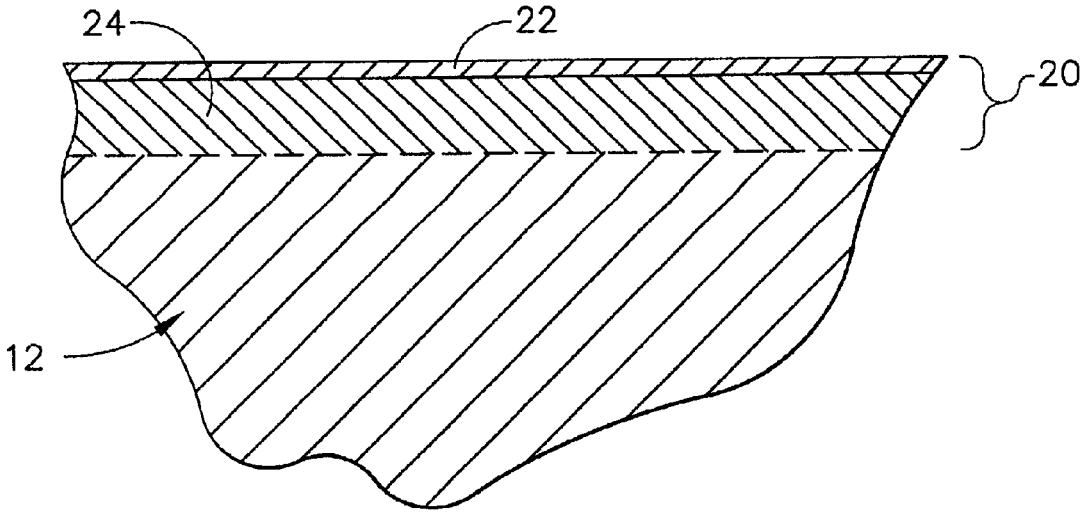
FIG. 2 represents a cross-sectional view of a diffusion aluminide coating on the blade of FIG. 1.

Represented in FIG. 2 is a diffusion aluminide coating 20 overlying a substrate region of the airfoil 12. A typical thickness for a diffusion aluminide coating used on gas turbine engine components is about 50 to about 125 micrometers. As known in the art, the diffusion aluminide coating 20 is formed by an aluminizing process, such as pack cementation, vapor phase (gas phase) aluminiding (VPA), or chemical vapor deposition (CVD), though it is foreseeable that other techniques could be used. Diffusion aluminide coating compositions are oxidation-resistant and form an alumina ($Al_2O_3$) layer or scale (not shown) on their surfaces during exposure to elevated temperatures. The alumina scale protects the underlying superalloy substrate from oxidation and hot corrosion.

The coating 20 is schematically represented in FIG. 2 as being composed of an additive layer 22 overlying the surface of the blade 10, and a diffusion zone 24 in the surface region of the blade 10, as is typical for all diffusion aluminide coatings. The diffusion zone (DZ) 24 contains various intermetallic and metastable phases that form during the coating reaction as a result of diffusional gradients and changes in elemental solubility in the local region of the substrate. The additive layer 22 is typically about 30 to 75 micrometers thick and contains the environmentally-resistant intermetallic phase MAI, where M is iron, nickel or cobalt, depending on the substrate material (mainly β(NiAl) if the substrate is Ni-base). The chemistry of the additive layer 22 can be modified by introducing into the coating process other elements, such as platinum, chromium, silicon, rhodium, hafnium, yttrium and zirconium. For example, if platinum is deposited on the substrate prior to aluminizing, the additive layer 22 contains (Pt)NiAl-type intermetallic phases.

Diffusion aluminide coatings of the type described above are the most widely used environmental coating for protecting turbine hardware because of their relatively low cost, simple equipment and coating operations, and the ability to be deposited without plugging air cooling holes. Due to high material and manufacturing costs, superalloy components having damaged or flawed diffusion aluminide coatings are repaired on a routine basis. The process of this invention is directed to the rejuvenation of the diffusion aluminide coating 20, and more particularly to removing at least a portion of the additive layer 22, such as when the additive layer 22 has been deposited to an excessive thickness in a process of rejuvenating the coating 20. The rejuvenation process of this invention is capable of removing the additive layer 22 without damaging the substrate material of the airfoil 12.

The repair process of this invention entails contacting the diffusion aluminide coating 20 with an acidic stripping solution containing phosphoric acid ($H_3PO_4$) and nitric acid ($HNO_3$). A suitable composition for the stripping solution is, by volume percent, about 25% to about 75% phosphoric acid containing about 85 weight percent $H_3PO_4$ (balance water), and about 25% to about 75% nitric acid containing about 75 weight percent $HNO_3$ (balance water). A preferred solution contains equal amounts of phosphoric and nitric acids at these specified concentrations, i.e., prepared by combining, by volume, about 50% phosphoric acid containing about 85 weight percent $H_3PO_4$, and about 50% nitric acid containing about 75 weight percent $HNO_3$. When a diffusion aluminide coating is contacted with the acidic stripping solution at a temperature of about 70° C. to about 80° C. (about 160° F. to about 180° F.), preferably about 75° C. (about 170° F.), for a duration of about 20 to about 30 minutes, preferably about 25 minutes, the additive layer 22 is stripped with a high level of selectivity with no measurable attack of the underlying superalloy substrate. Below the preferred temperature range, the activity of the solution is insufficient to remove the additive layer 22, while treatment temperatures above this range can result in attack of the superalloy substrate. The acid solution of this invention appears to selectively attack aluminum, particularly if the diffusion aluminide is a platinum aluminide, and therefore contains platinum intermetallics. While nitric acid and phosphoric acid are disclosed in U.S. Pat. No. 3,833,414 to Grisik et al., their use was for a process of completely stripping a diffusion aluminide coating, and not for the limited purpose of completely removing an additive layer of a diffusion aluminide coating.

Because of the selectivity of the stripping solution to the aluminum of the additive layer 22, the invention enables the removal of an excessively thick additive layer (e.g., in excess of 100 micrometers), as may result from a rejuvenation process. The selectivity of the stripping solution is most advantageous if the coating 20 has not seen high temperature service (i.e., the blade 10 has not been installed and operated in a gas turbine engine), so that limited interdiffusion has occurred between the blade superalloy, the additive layer 22 and the diffusion zone 24. Once the excess additive layer 22 of the original coating 20 is removed, a new additive layer of the desired thickness can be deposited without any risk of alloy depletion and thinning of the underlying substrate. If a platinum aluminide coating is desired, a flash of platinum (e.g., about two micrometers in thickness) can be deposited and diffused into the surface of the airfoil 12 exposed by the stripping operation (i.e., the diffusion zone 24 and any remaining portion of the original additive layer 22). A suitable process for diffusing the platinum layer is a thermal treatment of about two hours at about 1050° C. (about 1925° F.). A suitable re-aluminizing process is vapor phase aluminiding (VPA) performed at a temperature of about 1040° C. (about 1900° F.) for a duration of about six hours. Other diffusion aluminiding processes could be used, and are therefore within the scope of this invention.

During an investigation leading to the present invention, high pressure turbine (HPT) blades were treated with an acidic stripping solution of, by volume, about 50% phosphoric acid containing about 85 weight percent $H_3PO_4$, and about 50% nitric acid containing about 75 weight percent $HNO_3$. The blades were formed of a nickel-base superalloy known as René 142 and having a nominal composition, by weight, of about 12% cobalt, 6.8% chromium, 6.15% aluminum, 1.5% molybdenum, 4.9% tungsten, 6.35% tantalum, 2.8% rhenium, 1.5% hafnium, 0.12% carbon, and 0.015% boron, the balance nickel and incidental impurities. The blades were protected by a platinum aluminide coating that had been rejuvenated to form an additive layer whose thicknesses were in excess of 100 micrometers, which was deemed excessive for the particular application. The blades were contacted with the stripping solution at a temperature of about 170° F. (about 75° C.) for a duration of about twenty-five minutes, resulting in the additive layers being completely removed without damaging the underlying superalloy substrate. Following removal of the additive layers, a flash of platinum was plated on the exposed surfaces of the blades, which were then heat treated at about 1925° F. (about 1050° C.) to diffusion bond the platinum flash, and then realuminized by VPA at a temperature of about 1900° F. (about 1040° C.) for a duration of about six hours.

While the invention has been described in terms of a preferred embodiment, it is apparent that other forms could be adopted by one skilled in the art. For example, this invention is also applicable to a diffusion coating used as a bond coat for a thermal-insulating layer, as is often the case for high-temperature components of a gas turbine engine. Accordingly, the scope of the invention is to be limited only by the following claims.

What is claimed is:

1. A process for rejuvenating a platinum-containing diffusion aluminide coating on a component following deposition of the diffusion aluminide coating and before placing the component in service at an elevated temperature, the diffusion aluminide coating comprising an additive layer on a surface of the component and a diffusion zone below the additive layer and in a surface region of the component, the process comprising the steps of:

treating the diffusion aluminide coating to an aqueous solution consisting essentially of nitric acid and phosphoric acid at a temperature of about 70° C. to about 80° C. until at least part of the additive layer has been removed but the diffusion zone remains, thereby establishing a treated surface of the diffusion aluminide coating;

depositing a platinum layer on the treated surface;

heat treating the component to diffuse the platinum layer into the treated surface; and then aluminizing the treated surface of the component.

2. A process according to claim 1, wherein the aqueous solution consists of $HNO_3$, $H_3PO_4$, and water.

3. A process according to claim 1, wherein the diffusion aluminide coating is treated for a duration of about 20 to about 30 minutes.

4. A process according to claim 1, wherein the aqueous solution is at a temperature of about 75° C. and the diffusion aluminide coating is treated for a duration of about 25 minutes.

5. A process according to claim 1, further comprising the steps of depositing a platinum layer on the treated surface following the treating step, and then heat treating the component to diffuse the platinum layer into the treated surface before the aluminizing step.

6. A process according to claim 1, wherein the diffusion aluminide coating is present on the component as a result of aluminizing the component after the component has been placed in service at an elevated temperature.

7. A process according to claim 6, wherein the diffusion aluminide coating is present on the component at a thickness in excess of 100 micrometers prior to the treating step.

8. A process according to claim 1, wherein the component is a gas turbine engine component, and the diffusion aluminide coating is present on the component as a result of aluminizing the component after the component was installed on a gas turbine engine, the gas turbine engine was operated, and the component was removed from the gas turbine engine.

9. A process according to claim 8, wherein the diffusion aluminide coating is present on the component at a thickness in excess of 100 micrometers after the aluminizing step and prior to the treating step.

10. A process according to claim 1, wherein the treating step removes substantially all of the additive layer and does not damage the surface region of the component.

11. A process for rejuvenating a platinum-containing diffusion aluminide coating on a gas turbine engine component formed of a nickel or cobalt-base superalloy, the diffusion aluminide coating comprising an additive layer on a surface of the component and a diffusion zone below the additive layer and in a surface region of the component, the process comprising the steps of:

removing the component from a gas turbine engine after the gas turbine engine was operated;

aluminizing the component to form a rejuvenated diffusion aluminide coating having an additive layer with a thickness in excess of 100 micrometers;

before placing the component in service on a gas turbine engine, treating the diffusion aluminide coating to an aqueous solution consisting of about 50 volume percent nitric acid and about 50 volume percent phosphoric acid at a temperature of about 70° C. to about 80° C. for a duration of about 20 to about 30 minutes to remove at least part of the additive layer but the diffusion zone remains, thereby establishing a treated surface of the diffusion aluminide coating on the component;

depositing a platinum layer on the treated surface;

heat treating the component to diffuse the platinum layer into the treated surface; and then aluminizing the treated surface of the component to form a second rejuvenated diffusion aluminide coating having an additive layer with a thickness of not greater than 100 micrometers.

12. A process according to claim 11, wherein the aqueous solution consists of $HNO_3$, $H_3PO_4$, and water.

13. A process according to claim 11, wherein the aqueous solution is at a temperature of about 75° C. and the diffusion aluminide coating is treated for a duration of about 25 minutes.

14. A process according to claim 11, further comprising the steps of depositing a platinum layer on the treated surface following the treating step, and then heat treating the component to diffuse the platinum layer into the treated surface before the aluminizing step.

15. A process according to claim 11, wherein the treating step removes substantially all of the additive layer and does not damage the surface region of the component.

16. A process according to claim 11, wherein the step of aluminizing the treated surface is a vapor phase aluminiding process.

* * * * *